US006612372B1

(12) United States Patent
Freiheit et al.

(10) Patent No.: US 6,612,372 B1
(45) Date of Patent: Sep. 2, 2003

(54) TWO-STAGE DOWNHOLE PACKER

(75) Inventors: Roland R. Freiheit, Edmonton (CA); James F. Wilkin, Sherwood Park (CA)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/703,259

(22) Filed: Oct. 31, 2000

(51) Int. Cl.[7] ..... E21B 23/06; E21B 33/12

(52) U.S. Cl. ..... 166/387; 166/147; 166/187; 166/195

(58) Field of Search ..... 166/387, 179, 166/142, 146, 147, 184, 185, 186, 187, 188, 192, 194, 195, 203

(56) References Cited

U.S. PATENT DOCUMENTS

| | | | | |
|---|---|---|---|---|
| 2,306,160 A | | 12/1942 | Freyssinet | 288/6 |
| 2,519,116 A | | 8/1950 | Crake | 166/10 |
| 2,656,891 A | | 10/1953 | Toelke | 166/13 |
| 2,751,017 A | | 6/1956 | Baker et al. | 166/216 |
| 2,814,517 A | | 11/1957 | Razdow | 288/20 |
| 3,054,450 A | | 9/1962 | Baker | 166/120 |
| 3,147,016 A | | 9/1964 | Traufler | 277/226 |
| 3,298,440 A | | 1/1967 | Current | 166/123 |
| 3,507,327 A | | 4/1970 | Chenoweth | 166/134 |
| 3,623,551 A | | 11/1971 | Randermann, Jr. | 166/134 |
| 3,678,998 A | | 7/1972 | Cockrell et al. | 166/123 |
| 3,690,375 A | | 9/1972 | Shillander | 166/187 |
| 4,078,606 A | | 3/1978 | Montgomery | 166/120 |
| 4,146,093 A | | 3/1979 | Horvath et al. | 166/120 |
| 4,153,109 A | | 5/1979 | Szescila | 166/250 |
| 4,224,987 A | | 9/1980 | Allen | 166/120 |
| 4,253,676 A | | 3/1981 | Baker et al. | 277/34.6 |
| 4,289,200 A | | 9/1981 | Fisher, Jr. | 166/120 |
| 4,300,775 A | | 11/1981 | Ringel | 277/34.3 |
| 4,345,649 A | | 8/1982 | Baugh et al. | 166/120 |
| 4,353,420 A | * | 10/1982 | Miller | 166/113 |
| 4,375,240 A | * | 3/1983 | Baugh et al. | 166/120 |
| 4,403,660 A | | 9/1983 | Coone | 166/387 |
| 4,406,469 A | | 9/1983 | Allison | 277/123 |
| 4,436,150 A | | 3/1984 | Barker | 166/131 |
| 4,452,463 A | | 6/1984 | Buckner | 277/120 |
| 4,457,369 A | | 7/1984 | Henderson | 166/125 |
| 4,487,258 A | | 12/1984 | Jackson et al. | 166/120 |

(List continued on next page.)

FOREIGN PATENT DOCUMENTS

| | | | |
|---|---|---|---|
| EP | 0 237 662 A1 | 9/1987 | E21B/34/10 |
| EP | 0 959 226 A2 | 11/1999 | E21B/33/12 |
| FR | 2 586 781 | 3/1987 | F16J/15/34 |
| GB | 1 398 038 | 6/1975 | E21B/33/128 |

OTHER PUBLICATIONS

International Search Report from the European Patent Office for International Appl. No. PCT/GB01/04647, dated Mar. 19, 2002.

*Primary Examiner*—David Bagnell
*Assistant Examiner*—Jennifer H Gay
(74) *Attorney, Agent, or Firm*—Moser, Patterson & Sheridan, L.L.P.

(57) ABSTRACT

A two-stage packer and method for sealing an annulus in a wellbore is provided. The packer may be set by a force which will not cause a sealing element to buckle, collapse, or otherwise fail. In one aspect, the packer comprises a body having a sealing element and shoulder disposed there-around, and a slideable member slideably arranged on the body, the slideable member having a first surface disposable beneath the element to increase the inner diameter thereof and a second surface disposable against an end of the element to increase the outer diameter thereof. The method comprises running a body into the wellbore, the body comprising a sealing element and a slideable member slide-ably disposed there-around, wherein the slideable member comprises a first surface and a second surface; forcing the first surface beneath the element to increase the inner diameter thereof; and forcing the second surface against an end of the element to increase the outer diameter thereof.

15 Claims, 3 Drawing Sheets

U.S. PATENT DOCUMENTS 4,499,947 A * 2/1985 Zsoka et al. ..... 166/179
4,540,047 A * 9/1985 Akkerman ..... 166/117.5
4,573,537 A 3/1986 Hirasuna et al. ..... 166/387
4,601,498 A 7/1986 Haugen ..... 285/332.3
4,640,351 A * 2/1987 Clifton et al. ..... 166/127
4,662,450 A 5/1987 Haugen ..... 166/299
4,674,570 A 6/1987 Jackson ..... 166/187
4,708,202 A 11/1987 Sukup et al. ..... 166/123
4,730,670 A 3/1988 Kim ..... 166/134
4,749,035 A * 6/1988 Cassity ..... 166/120
4,753,444 A 6/1988 Jackson et al. ..... 277/230
4,762,179 A 8/1988 Wesson et al. ..... 166/297
4,784,226 A 11/1988 Wyatt ..... 166/376
4,834,175 A * 5/1989 Ross et al. ..... 166/120
4,886,117 A 12/1989 Patel ..... 166/187
4,898,239 A 2/1990 Rosenthal ..... 166/187
4,907,651 A 3/1990 Bou-Mikael ..... 166/114
4,913,232 A 4/1990 Cheymol et al. ..... 166/285
5,044,441 A 9/1991 Rubbo et al. ..... 166/382
5,165,703 A 11/1992 Morvant ..... 277/188
5,226,492 A 7/1993 Solaeche P. et al. ..... 166/196
5,271,469 A 12/1993 Brooks et al. ..... 166/387
5,309,993 A 5/1994 Coon et al. ..... 166/115
5,311,938 A 5/1994 Hendrickson et al. ..... 166/134
5,332,038 A 7/1994 Tapp et al. ..... 166/278
5,433,269 A 7/1995 Hendrickson ..... 166/134
5,511,620 A 4/1996 Baugh et al. ..... 166/387
5,605,195 A 2/1997 Eslinger et al. ..... 166/387
5,620,050 A * 4/1997 Barbee ..... 166/120
5,636,689 A 6/1997 Rubbo et al. ..... 166/123
5,676,384 A 10/1997 Culpepper ..... 277/188
5,678,635 A 10/1997 Dunlap et al. ..... 166/387
5,711,372 A 1/1998 Stokley ..... 166/187
5,749,585 A 5/1998 Lembcke ..... 277/116.2
5,775,429 A 7/1998 Arizmendi et al. ..... 166/387
5,787,987 A 8/1998 Forsyth et al. ..... 166/313
5,803,178 A 9/1998 Cain ..... 166/306
5,810,082 A 9/1998 Jordan, Jr. ..... 166/120
5,819,846 A 10/1998 Bolt, Jr. ..... 166/123
5,833,001 A 11/1998 Song et al. ..... 166/287
5,875,841 A 3/1999 Wright et al. ..... 166/85.4
5,875,847 A 3/1999 Forsyth ..... 166/313
5,941,313 A 8/1999 Arizmendi ..... 166/387
6,009,951 A 1/2000 Coronado et al. ..... 166/387
6,041,858 A 3/2000 Arizmendi ..... 166/187
6,102,117 A 8/2000 Swor et al. ..... 166/138
6,116,339 A 9/2000 Milne et al. ..... 166/125
6,244,642 B1 6/2001 Serafin et al. ..... 294/86.17
6,318,461 B1 11/2001 Carisella ..... 166/196

* cited by examiner

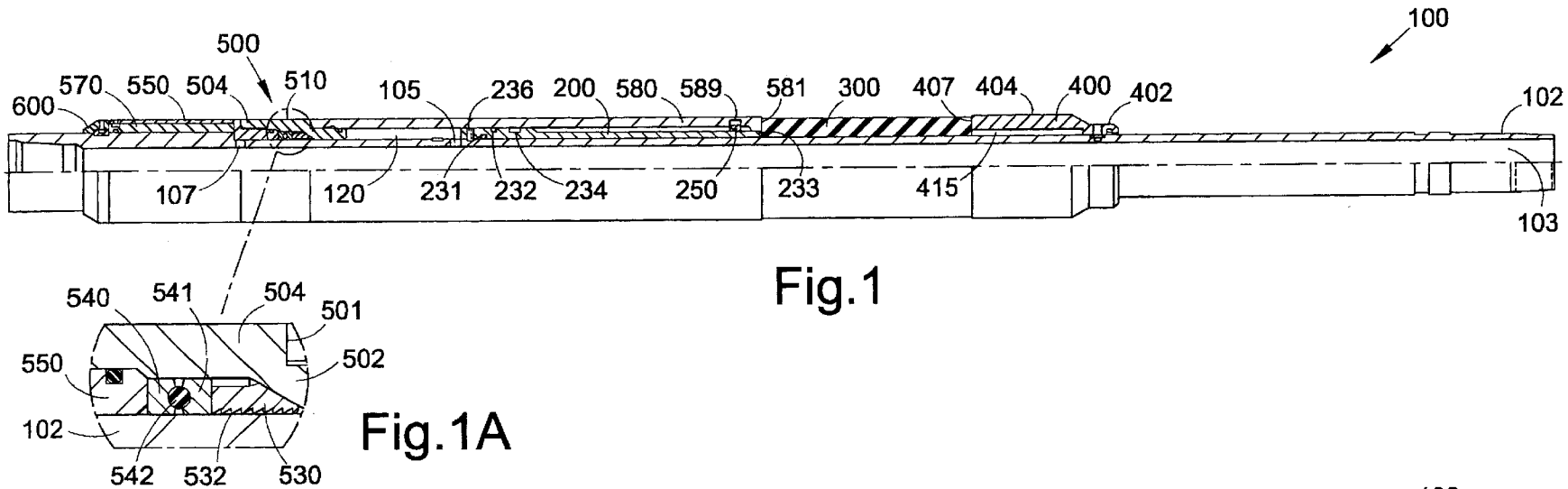
Fig.1
Fig.1A
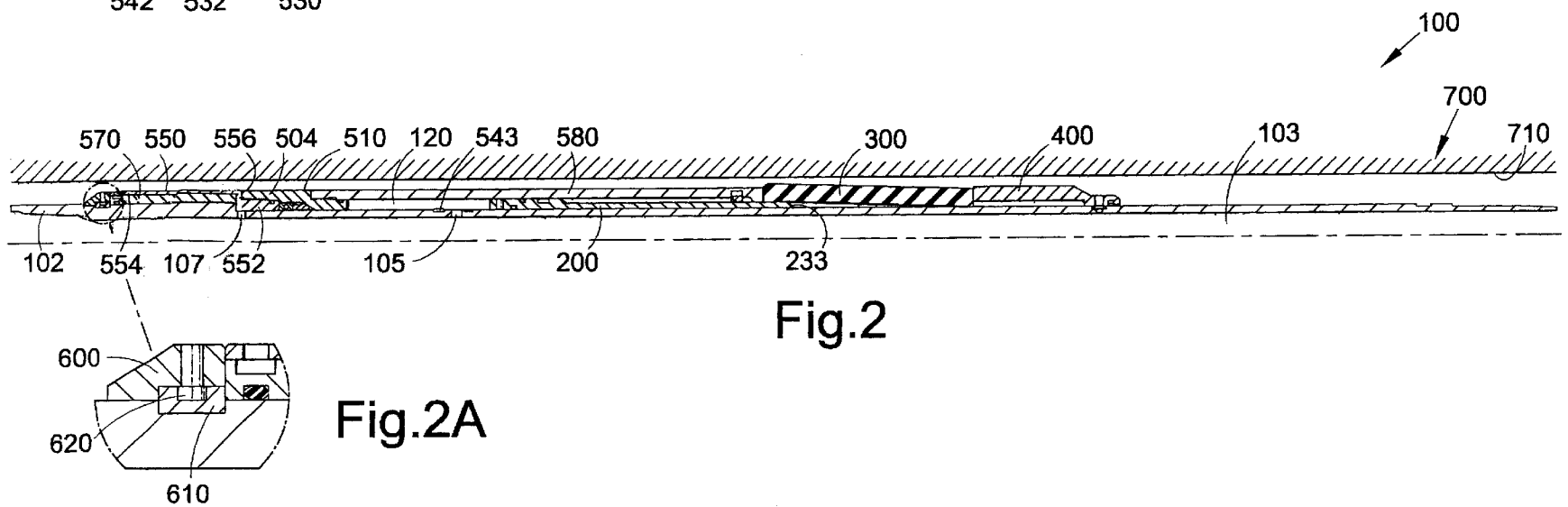
Fig.2
Fig.2A

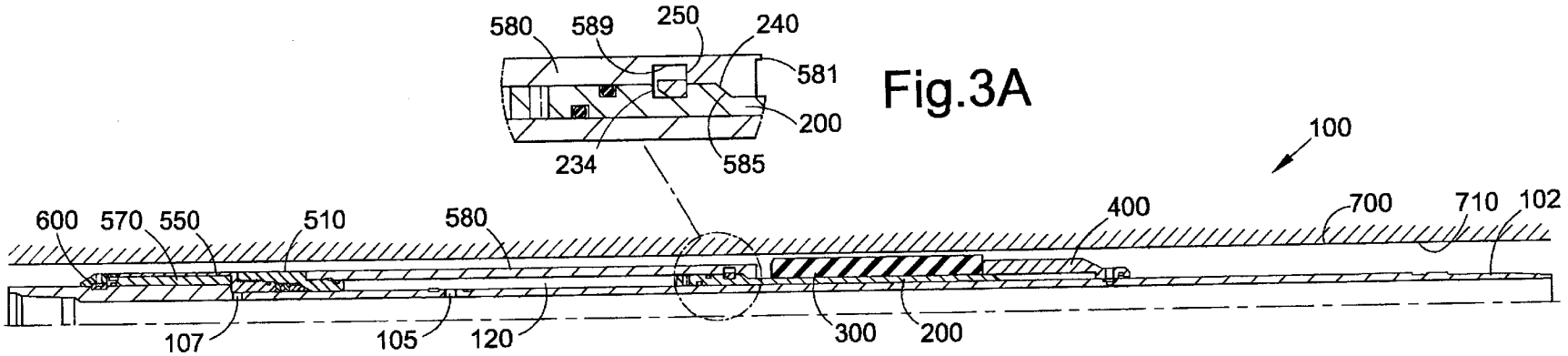
Fig.3A
Fig.3
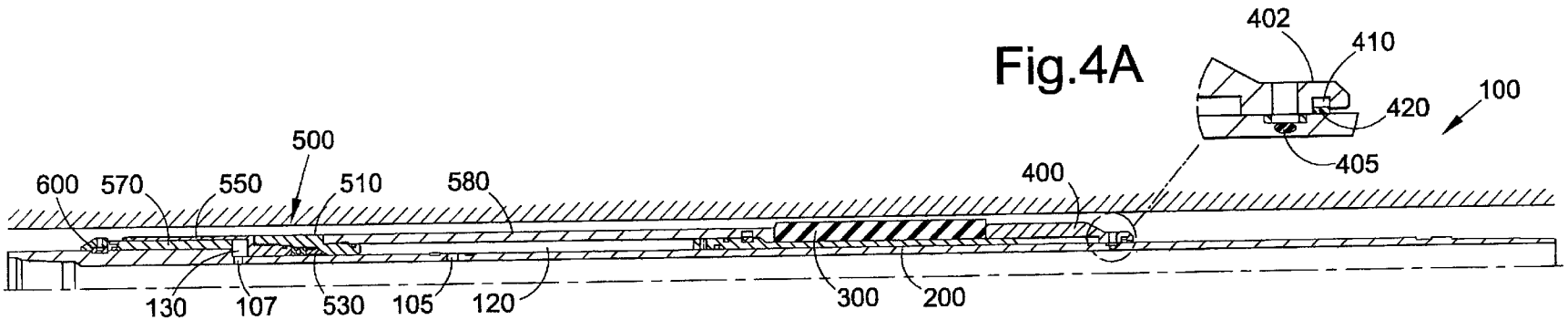
Fig.4A
Fig.4

TWO-STAGE DOWNHOLE PACKER

BACKGROUND OF THE INVENTION

1. Field of the Invention

The present invention relates to downhole packers. More particularly, the present invention relates to a two-stage, retrievable, expandable packer for sealing an annulus within a wellbore.

2. Background of the Related Art

Downhole packers are typically used to seal an annular area formed between two coaxially disposed tubulars within a wellbore. A packer may seal, for example, an annulus formed between production tubing disposed within wellbore casing. Alternatively, some packers seal an annulus between the outside of a tubular and an unlined borehole. Routine uses of packers include the protection of casing from pressure, both well and stimulation pressures, and protection of the wellbore casing from corrosive fluids. Other common uses may include the isolation of formations or of leaks within wellbore casing, squeezed perforation, or multiple producing zones of a well, thereby preventing migration of fluid or pressure between zones. Packers may also be used to hold kill fluids or treating fluids in the casing annulus.

Packers typically are either permanently set in a wellbore or retrievable. Permanent packers are installed in the wellbore with mechanical compression setting tools, fluid pressure devices, inflatable charges, or with cement or other materials pumped into an inflatable seal element. Due to the difficulty of removing permanent packers, retrievable packers to permit the deployment and retrieval of the packer from a particular wellbore location. Retrievable packers have a means for setting and then deactivating a sealing element, thereby permitting the device to be pulled back out of the wellbore.

Conventional packers typically comprise a sealing element between upper and lower retaining rings or elements. The sealing element is compressed to radially expand the sealing element outwardly into contact with the well casing therearound, thereby sealing the annulus.

One problem associated with conventional packers arises when a relatively large annular area between two tubulars is to be sealed. Conventional packers, because they rely solely on compressive forces applied to the ends of the sealing member, are sometimes ineffective in sealing these larger areas. If the annular area to be sealed is relatively large, the sealing element must be extensively compressed to fill the annulus. Often times, the element buckles due to the compressive forces, thereby effecting an incomplete seal or a seal that is prone to premature failure. Therefore, there is a need for an expandable packer that can be more effectively used in sealing annular areas between tubulars.

SUMMARY OF THE INVENTION

A packer for sealing an annulus in a wellbore is provided wherein the sealing element is actuated in a two-stage process. In one aspect, the packer comprises a body having a sealing element, a shoulder disposed there-around, and a slideable member arranged on the body. The slideable member has a first surface disposable beneath the element to increase the inner diameter thereof and a second surface disposable against an end of the element to compress the element against the shoulder to increase the outer diameter thereof.

In another aspect, the invention comprises a packer for sealing an annulus in a wellbore, comprising an annular body having at least one port disposed in an outer surface thereof; a shoulder disposed about the body; a slideable member slideably disposed about the body; and a sealing element disposed about the body between the shoulder and the slideable member whereby the element is expandable upon movement of the slideable member towards the shoulder. The slideable member has a first surface disposable beneath the element to increase the inner diameter thereof and a second surface disposable against an end of the element to compress the element and increase the outer diameter thereof. The ratchet mechanism retains the element in the compressed position to seal an annular area between the body and the inner surface of the tubular.

In still another aspect, a method for actuating a packer in a wellbore is provided. The method comprises running a body into the wellbore, the body comprising a sealing element a shoulder, and a slideable member slideably disposed there-around, wherein the slideable member comprise a first surface and a second surface; forcing the first surface beneath the element to increase the inner diameter thereof; and forcing the second surface against an end of the element to increase the outer diameter thereof.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 1 is a partial section view of a down hole packer.

FIG. 1A is an enlarged section view of a ratchet housing.

FIG. 2 is a partial section view of a downhole packer disposed in a wellbore during a first stage of activation.

FIG. 2A is an enlarged section view of a containment ring.

FIG. 3 is a partial section view of a downhole two-stage packer after the first stage of activation.

FIG. 3A an enlarged section view of a mating engagement between a cylinder and a lower piston.

FIG. 4 is a partial section view of a downhole two-stage packer at the beginning of a second stage of activation.

FIG. 4A is an enlarged section view of a first section of a lower gauge ring.

DETAILED DESCRIPTION OF THE PREFERRED EMBODIMENT

Figure 5:
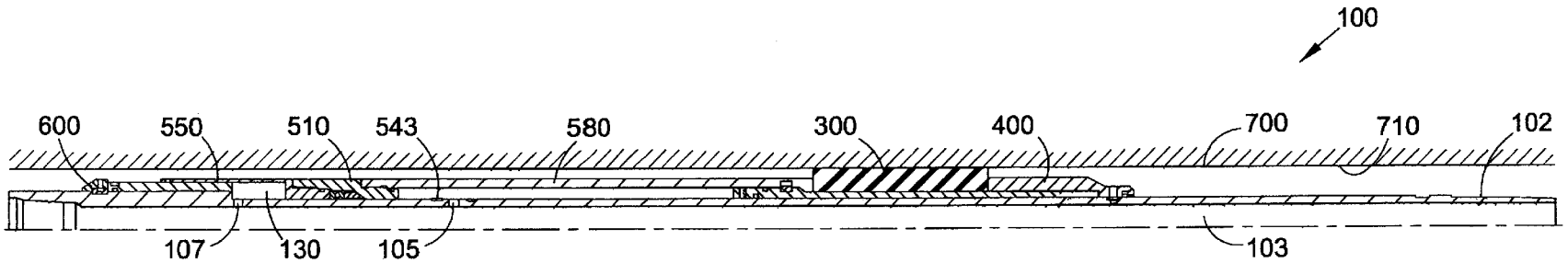
FIG. 5 is a partial section view of a downhole two-stage packer after a second stage of activation.

FIG. 1 is a partial section view of a two-stage down hole packer 100. The packer 100 includes a body 102, a lower piston 200, a sealing element 300, a shoulder 400, a ratcheting piston assembly 500, and a running ring 600, each disposed about an outer surface of the body 102. FIG. 1A is an enlarged section view showing portions of the ratcheting piston assembly in greater detail. The ratcheting piston assembly 500 includes a ratchet housing 510, a slip ratchet 530, containment rings 540, 541, an upper piston 550, a seal ring 570, and a cylinder 580.

For ease and clarity of description, the packer 100 will be further described in more detail as if disposed within a tubular 700 in a vertical position wherein the top of the packer is the left-hand corner of FIGS. 1–6. It is to be understood, however, that the packer 100 may be disposed in any orientation, whether vertical or horizontal. Furthermore, the packer 100 may be disposed in a borehole without a tubular casing there-around.

The body 102 is a tubular member having a longitudinal bore 103 there-through. The body 102 also includes a first port 105 that allows for fluid communication between the bore 103 and a first variable volume chamber 120 which is adjacent an upper surface of the lower piston 200. The body 102 further includes a second port 107 that allows for fluid communication between the bore 103 and a second variable volume chamber 130. The second chamber 130 will be described below in operation with the packer 100.

The lower piston 200 is disposed about the body 102 with a first end adjacent the sealing element 300. A plurality of shear pins 236 releasably retain the lower piston 200 in a first position relative to the body 102. The lower piston 200 includes two annular grooves 231, 232 disposed therein to house elastomeric seals or the like to form a fluid barrier between the first chamber 120 and fluid in the wellbore. Referring to FIG. 1A, the lower piston 200 includes a sloped surface 233. Also included in the lower piston is a recessed groove 234 disposed in an inner surface thereof that is engageable with a lock ring 250. The piston 200 further includes a tapered shoulder 240 which contacts a similarly tapered inner surface 585 of the cylinder 580. The engagement of the shoulders 240, 585 allows the lower piston 200 and the cylinder 580 to move together along body 102.

As will be explained, the tapered surface 233 travels underneath an inner surface of the sealing element 300. The tapered shoulder 240 engages the tapered shoulder 585 of the cylinder 580, and the recessed groove 234 of the lower piston 200 engages the lock ring 250. Thereafter, the lower piston 200 and the cylinder 580 move together along the body 102 as one unit. The lock ring 250 prevents movement of the lower piston 200 in an opposite direction.

The sealing element 300 is an annular member disposed about the body 102 between the lower piston 200 and the shoulder 400. The sealing element 300 may have any number of configurations to effectively seal the annulus created between the body 102 and a tubular there-around. For example, the sealing element 300 may include grooves, ridges, indentations or protrusions designed to allow the sealing element 300 to conform to variations in the shape of the interior of the tubular. The sealing element 300 can be constructed of any expandable or otherwise malleable material which creates a set position and stabilizes the body 102 relative to the tubular and which a differential force between the bore 103 of the body 102 and the wellbore does not cause the sealing element 300 to relax or shrink over time due to tool movement or thermal fluctuations within the wellbore. For example, the sealing member 300 may be a metal, a plastic, an elastomer, or a combination thereof.

The shoulder 400 is an annular member disposed about a lower portion of the body 102, and adjacent a lower portion of the sealing element 300. In the preferred embodiment, the shoulder is a releasable shoulder and includes a first 402 and second section 404. The first section 402 is offset from the second section 404 thereby forming a cavity 415 between an inner surface of the second section 404 and the outer surface of the body 102. Referring to FIGS. 4 and 4A, the first section 402 of the shoulder 400 includes a plurality of shear pins 405 which releasably engage the shoulder 400 to the body 102. The first section 402 further includes a recessed groove 410 disposed about an inner surface thereof. The recessed groove 410 houses a snap ring 420 disposed about the outer surface of the body 102. The snap ring 420 is disposed about the body 102 within an annular groove (not shown) formed in the outer surface of the body 102 and extends within the recessed groove 410. The snap ring 420 prevents the shoulder 400 from upward axial movement along the body which may be caused by contact between the packer 100 and the wellbore, as the packer 100 is run into the well.

Referring again to FIG. 1, the second section 404 of the shoulder 400 includes a substantially flat upper surface which abuts a lower surface of the sealing member 300. The upper surface also includes a radial protrusion 407 which abuts the lower surface of the sealing element 300. As the sealing element 300 moves radially outward from the body 102, the radial protrusion 407 presses into the sealing element 300 thereby providing a seal between the sealing element 300 and the shoulder 400.

The ratcheting piston assembly 500 includes the slip ratchet 530 and containment rings 540, 541 disposed about an upper end of the body 102. An inner surface of the slip ratchet 530 includes teeth or serrations 532 to contact the outer surface of the body 102. An outer surface of the slip ratchet 530 may be tapered to form a wedged or coned surface to complement a similar inner surface of the ratchet housing 510. The containment rings 540, 541 are concentric rings disposed about the body 102. An expandable member 542 is disposed about the body 102 between the two rings 540, 541. The expandable member 542 is a spring-like member which applies an axial force against the containment rings 540, 541. In particular, the expandable member 542 creates an axial force which drives the teeth 532 of the inner surface of the slip ratchet 530 into the outer surface of the body 102 thereby holding the ratcheting piston assembly 500 firmly against the body 102.

The ratchet housing 510 is an annular member disposed about the slip ratchet 530 and containment rings 540, 541. The ratchet housing 510 includes a first 502 and second section 504. The first section 502 is offset from the second section 504, thereby forming a substantially flat shoulder 501. The first section 502 is disposed radially between the body 102 and the upper end of the cylinder 580. The second section 504 is disposed radially about the slip ratchet 530 and a lower section of the upper piston 550. The shoulder 501 is adjacent to and contacts the upper surface of the cylinder 580. The ratchet housing 510 further includes an annular groove disposed about an outer surface of the first section 502 to house an elastomeric seal or the like to form a fluid barrier between the ratchet housing 510 and the cylinder 580.

Referring to FIG. 2, the upper piston 550 is an annular member disposed about the body 102 adjacent the ratchet housing 510. The upper piston 550 includes a first 552 and second section 554. The first section 552 is offset from the second section 554 thereby forming a substantially flat shoulder 556. The first section 552 is disposed radially between the body 102 and the second section 504 of the ratchet housing 510. The second section 554 is disposed radially about the seal ring 570. The shoulder 556 is adjacent to and contacts an upper surface of the second section 504 of the ratchet housing 510. The upper piston 550 further includes an annular groove disposed about an outer surface of the first section 552 to house an elastomeric seal or the like to form a fluid barrier between the upper piston 550 and the ratchet housing 510. The second port 107 is disposed within the outer surface of the body 102 adjacent the offset interface between the first 552 and second 554 sections of the upper piston 550.

Referring again to FIG. 1, the cylinder 580 is disposed about the lower piston 200 between the ratchet housing 510 and the sealing element 300. An upper surface of the cylinder 580 abuts the shoulder 501 of the ratchet housing 510. The first chamber 120 is formed by an inner surface of the cylinder 580 and an outer surface of the body 102. The lower piston 200 lies within a portion of the chamber 120. The chamber 120 is in fluid communication with the bore 103 via the port 105 formed in the outer surface of the body 102. Both the cylinder 580 and the lower piston 200 are longitudinally movable along the body 102.

The cylinder 580 also includes a recessed groove 589 formed in an inner surface thereof. The recessed groove 589 houses the lock ring 250. As stated above, the recessed groove 234 within the lower piston 200 is engageable with the lock ring 250 which extends radially from an inner surface of the cylinder 580. After the lower piston 200 moves axially along the outer surface of the body 102 to a predetermined position, the lock ring 250 snaps into place within the recessed groove 234 of the lower piston 200. Afterwards, the cylinder 580 and the lower piston 200 move along the housing together.

Figure 6A:
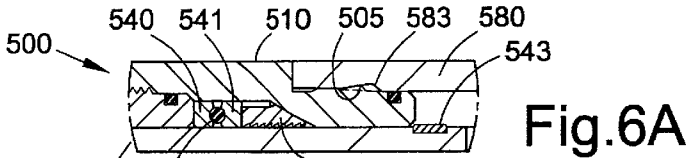
FIG. 6A is an enlarged section view of an ratcheting piston assembly.
Figure 6:
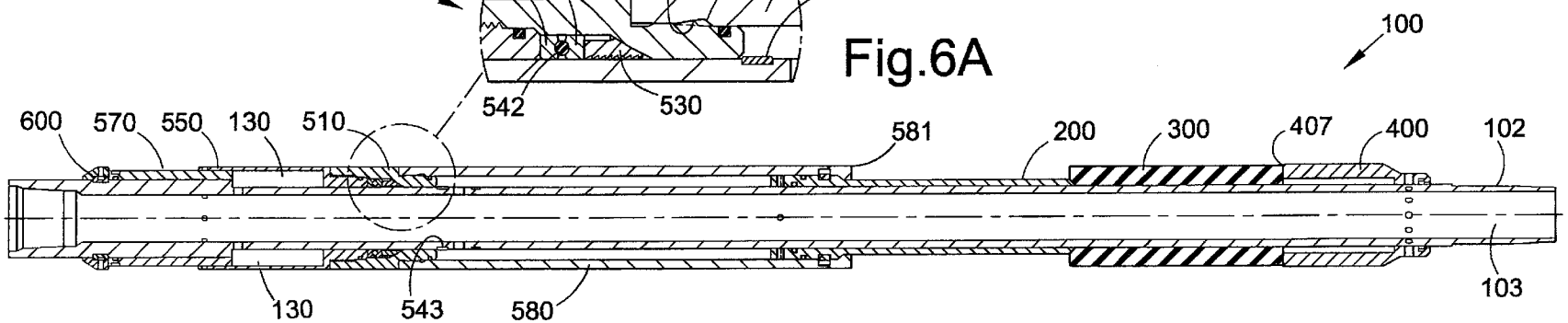
FIG. 6 is a partial section view of a downhole two-stage packer during the release and recovery of the packer.

The cylinder 580 further includes a lower end having an axial protrusion or extension 581 which abuts an upper end of the sealing element 300. As the sealing element 300 moves radially outward from the body 102, the extension 581 presses into the sealing element 300 thereby providing a seal between the sealing element 300 and the cylinder 580. Referring to FIG. 6, the cylinder 580 also includes a recessed groove or indentation 583 formed in an inner surface thereof toward a second end of the cylinder 580. The indentation 583 engages a ridge or radial protrusion 505 extending from an outer surface of the ratchet housing. The radial protrusion 505 rests within the indentation 583, engaging the ratchet housing 510 to the cylinder 580.

Referring to FIGS. 2 and 2A, the running ring 600 is disposed about a split ring 610 at an upper end of the body 102. For assembly purposes, the running ring 600 and the slip ring 610 are separate pieces. The running ring 600 and the split ring 610 prevent upward axial forces from moving the slideable components described herein once the packer 100 has been actuated within the wellbore. The split ring 610 is disposed about an annular groove disposed within the outer surface of the body 102. The running ring 600 and the split ring 610 are releasably engaged to each other and the body 102 by a plurality of shear pins 620. A stop ring 543 is also disposed about the body 102 within the first chamber 120. The stop ring 543 prevents the ratcheting piston assembly 500 from over-travelling along the body 102 upon the operation and release of the packer 100. The operation of the packer 100 and the interaction of the various components described above will be described in detail below.

FIG. 2 is a partial section view of a downhole packer 100 disposed in a wellbore during a first stage of activation. The packer 100 is first attached within a string of tubulars (not shown) and run down a wellbore 700 to a desired location. A fluid pressure is then supplied through the ports 105, 107, and to the first and second chambers 120, 130. The fluid pressure within the chambers 120, 130 is substantially equal to the pressure within the bore 103.

Referring to FIGS. 1–2, once the fluid pressure reaches a predetermined value which exceeds the sum of the wellbore pressure and the shear strength of the pins, the pins 236 shear allowing the lower piston 200 to move axially along the body 102 from a first position to a second position before any other components of the packer 100 are set in motion. In this manner, the lower piston moves to a position underneath the inner surface of the sealing element 300 as shown in FIG. 3.

FIG. 3 is a partial section view of the packer of FIG. 2 after the first stage of activation. As shown in FIGS. 3 and 3A, the lower piston 200 has traveled underneath the element 300 to its second position thereby moving the element 300 closer to the inner surface of the tubular 710 there-around. As the lower piston 200 reaches the second position, the lock ring 250 snaps into the annular groove 234. Thereafter, the lower piston 200 and the cylinder 580 move along the body 102 as one unit.

FIG. 4 is a partial section view of the packer of FIG. 2 at the beginning of a second stage of activation. During the second stage of activation, the fluid pressure through second port 107 acting upon a piston surface formed on upper piston 550 reaches a predetermined value which sets the upper piston 550 in motion. Movement of the upper piston 550 away from the seal ring 570 enlarges the volume of the second chamber 130 which is illustrated in FIG. 4.

The ratchet housing 510, slip ratchet 530, cylinder 580 and lower piston 200 move along the body 102 with the upper piston 550. The slip ratchet 530 with teeth 532 on an inner surface thereof prevent the ratcheting piston assembly 500 from travelling back towards its initial position. In the preferred embodiment, the teeth 532 are angled opposite the direction of travel to grip the outer surface of the body to prevent axial movement. The expandable member 542 disposed between the containment rings 540, 541 acts to provide a spring-like axial force directly to the upper surface of the slip ratchet 530 thereby driving the teeth toward the surface of the body 102. FIG. 6, described below, shows an expanded view of the containment rings 540, 541 and the slip ratchet 530.

As the components 200, 510, 530, and 580, travel along the body 102, the lower surface of the cylinder 580 transfers force against the upper surface of the sealing element 300. Because the lower surface of the sealing element is held by the shoulder 400, element 300 is compressed by the opposing forces and caused to expand radially as shown in FIG. 5.

FIG. 5 is a partial section view of the packer of FIG. 2 after the second stage of activation. As shown, the sealing element 300 has been longitudinally compressed and fully expanded in the radial direction thereby effectively sealing the annulus there-around. The second chamber 130 has further increased in volume. Further, as mentioned above, the axial protrusion 581 disposed on the lower surface of the cylinder 580 and the similar axial protrusion 407 disposed on the upper surface of the shoulder 400 provide a fluid seal with the sealing member 300. Consequently, the sealing element 300 provides a fluid-tight seal within the annulus.

In one aspect, the packer 100 is removable from a wellbore. FIG. 6 is a partial section view of the packer during the release and recovery of the packer. To release the activated packer 100, upward forces are applied which exceed the shear value of the pins 405. An upward axial force may be supplied from the surface of the well. Once the pins 405 release, the shoulder 400 travels axially along the body 102 from a first position to a second position. The release of the shoulder 400 relaxes the sealing element 300. The ratcheting assembly 500 is also released and free to move axially along the body 102 between the stop ring 543 and the seal ring 570. The stop ring 543 prevents the upper ratcheting assembly 550 from over-travelling along the body 102 in the direction of the sealing element 300, as shown in FIG. 6A. The stop ring 543 also prevents the cylinder 580 from further contacting the sealing element 300 and re-activating the packer 100.

While the foregoing is directed to the preferred embodiment of the present invention, other and further embodiments of the invention may be devised without departing from the basic scope thereof. The scope thereof is determined by the claims that follow.

What is claimed is:

1. A packer for sealing an annulus in a wellbore, comprising:

a body;

a sealing element circumferentially disposed about the body;

a shoulder also disposed about the body, adjacent an end of the sealing element; and a slideable member disposed on the body comprising:

a first surface disposed adjacent an end of the sealing element opposite the shoulder when the slideable member is in an initial position, and movable axially along an inner surface of the sealing element towards the shoulder to enlarge an inner diameter of the sealing element when the slideable member is in a second position; and a second surface that compresses the sealing element in the direction of the shoulder to increase the outer diameter of the sealing element when the slideable member is in its second position.

2. The packer of claim 1, wherein a temporary mechanical connection retains the slideable member in the initial position.

3. The packer of claim 2, wherein a predetermined force releases the temporary connection allowing the slideable member to move from the initial position.

4. The packer of claim 1, wherein the first surface is disposed on a first slideable member and the second surface is disposed on a second slideable member, the first and second slideable members fixable together into a single unit.

5. The packer of claim 1, further comprising at least one port disposed in the body to communicate a fluid pressure to a first piston surface formed on the slideable member.

6. A packer according to claim 1, wherein said first surface includes a sloped surface.

7. The packer of claim 1, wherein the first surface of the slideable member contacts the element and then the second surface of the slideable member contacts the element.

8. A packer for sealing an annulus in a wellbore, comprising:

an annular body;

a shoulder disposed about the body;

a slideable member slideably disposed about the body, the slideable member comprising a first surface and a second surface; and a sealing element disposed about the body between the shoulder and the slideable member;

wherein the slideable member is initially disposed adjacent an end of the sealing element, and then moves axially along the body to a second position between an inner surface of the sealing element and an outer surface of the body such that the first surface of the slideable member is disposed underneath the inner surface of the sealing element to increase the inner diameter of the sealing element, and the second surface of the slideable member is disposable against an end of the sealing element to compress the element between the second surface of the slideable member and the shoulder to increase the outer diameter of the sealing element.

9. The packer of claim 8, wherein the slideable member includes a piston surface in fluid communication with an interior of the body.

10. The packer of claim 9, wherein the slideable member is fixed to the body by a temporary connection, the connection terminating upon a predetermined fluid pressure applied to the piston surface.

11. The packer of claim 10, wherein the temporary connection is a shearable connection.

12. The packer of claim 11, wherein the predetermined pressure exceeds a wellbore pressure and a shear strength of at least one shearable member.

13. A method for actuating a packer in a wellbore, comprising:

running a body into the wellbore, the body comprising a sealing element, a shoulder, and a slideable member, each disposed there-around, wherein the slideable member comprises a first surface and a second surface;

urging the first surface beneath the element to increase the inner diameter thereof; and thereafter urging the second surface against an end of the element to increase the outer diameter thereof.

14. A method for releasing an actuated packer in a wellbore, comprising the steps of:

activating a packer in a wellbore, the packer comprising:

a tubular body, a sealing element disposed circumferentially about the body, a piston also disposed about the body, the piston having been moved relative to the body from a first position adjacent an end of the sealing element to a second position substantially between an inner surface of the sealing element and the body to increase the inner diameter of the sealing element, a cylinder also disposed about the body and acting to compress the sealing element from a first end of the sealing element, the cylinder having been moved with the piston to contact the sealing element after the piston contacted the sealing element, and a shoulder disposed about the body, the sealing element being compressed between the shoulder and the cylinder to increase the outer diameter of the sealing element, and;

retracting the cylinder and the piston relative to the sealing element and the shoulder, thereby releasing the packer.

15. A packer for sealing an annulus in a wellbore, comprising:

a body having an outer surface;

a sealing element circumferentially disposed about the outer surface of the body;

a first shoulder also disposed about the outer surface of the body, adjacent an end of the sealing element; and a slideable member disposed on the outer surface of the body, the slideable member sliding relative to the body between a first position adjacent an end of the sealing element opposite the first shoulder, and a second position between the sealing element and the outer surface of the body, the slideable member comprising;

a beveled surface that is substantially received between the sealing element and the outer surface of the body as the slideable member moves from its first position to its second position to increase the inner diameter of the sealing element; and a second shoulder that abuts an end of the sealing element opposite the first shoulder when the slideable member moves to its second position so as to compress the sealing element between the first and second shoulders, thereby increasing the outer diameter of the sealing element.

* * * * *